United States Patent [19]

Hirano

[11] Patent Number: 4,500,892

[45] Date of Patent: Feb. 19, 1985

[54] SERIAL THERMAL PRINTER

[75] Inventor: Seiichi Hirano, Shiojiri, Japan

[73] Assignee: Epson Corporation, Tokyo, Japan

[21] Appl. No.: 515,087

[22] Filed: Jul. 18, 1983

[30] Foreign Application Priority Data

Jul. 21, 1982 [JP] Japan ..... 57-128008

[51] Int. Cl.[3] ..... B41J 3/20

[52] U.S. Cl. ..... 346/76 PH; 346/139 R; 400/320; 400/120

[58] Field of Search ..... 400/320, 120; 346/139 R, 139 A, 139 B, 139 C, 139 D, 76 PH; 219/216 PH

[56] References Cited

U.S. PATENT DOCUMENTS

| | | | |
|---|---|---|---|
| 4,173,273 | 11/1979 | Hanakata | 400/120 |
| 4,300,844 | 11/1981 | Keil | 346/76 PH |
| 4,429,318 | 1/1984 | Kobata | 346/76 PH |
| 4,439,777 | 3/1984 | Aprato | 346/76 PH |

*Primary Examiner*—E. A. Goldberg
*Assistant Examiner*—A. Evans
*Attorney, Agent, or Firm*—Blum, Kaplan, Friedman, Silberman & Beran

[57] ABSTRACT

A serial printer for printing on a thermosensitive recording medium. The printer includes a frame having a carriage supported thereon for lateral movement across the recording medium. A thermal print head is supported on the carriage for lateral displacement therewith for printing on the recording medium. A platen is supported on the frame for supporting the recording medium so that the print head can be pressed against the recording medium to effect thermal printing thereon. A motor having a relatively flat configuration is supported on the frame and includes a vertical rotatable shaft which is rotated by the motor. A drive gear system is operatively coupled to the rotatable shaft of the motor for selective rotation thereby in opposite directions in response to rotation by the motor. A conversion mechanism converts rotation of the drive gear into lateral movement of the carriage. A paper feed mechanism for feeding the recording medium past the print head and a platen release mechanism for releasing the print head from engagement with the platen are operatively coupled to the carriage for selective actuation thereby.

20 Claims, 10 Drawing Figures

8
7
602
1
9
122
121
6
101
2
10b
601
102
12
13
100
11
3
10a
5
4
14
16a
16
158
3a
156
4a
159
15
157
150

FIG. 2
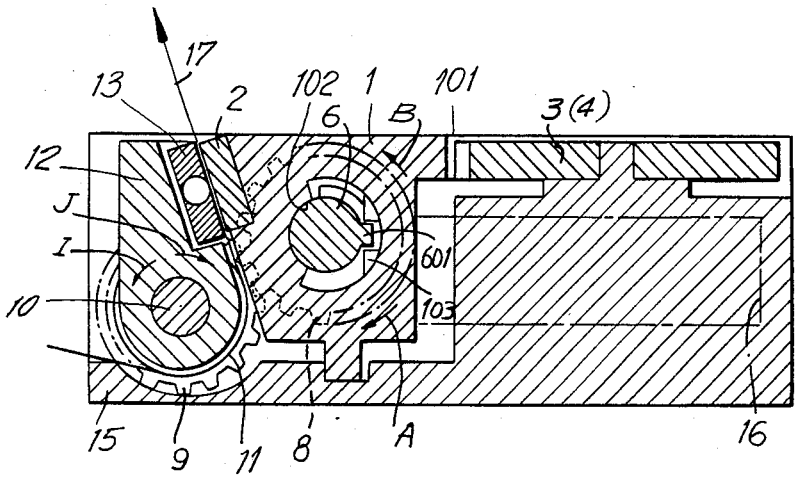
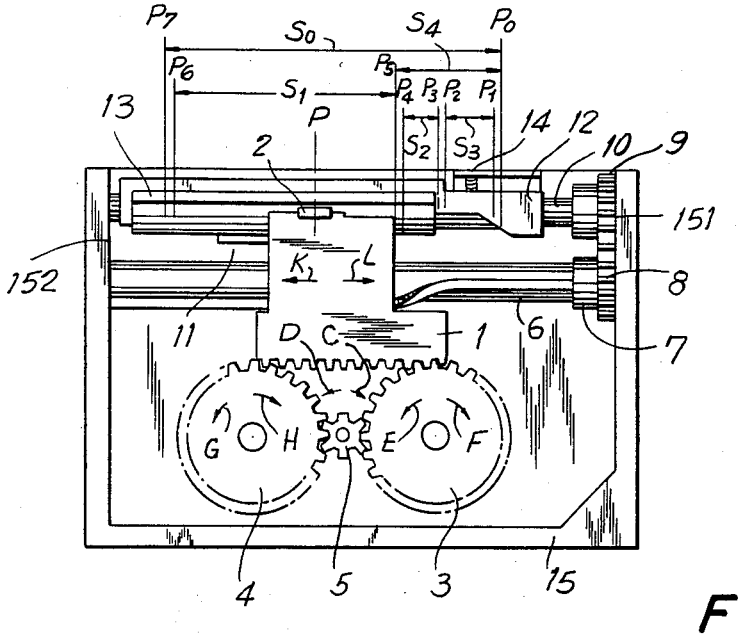
FIG. 3

FIG. 6
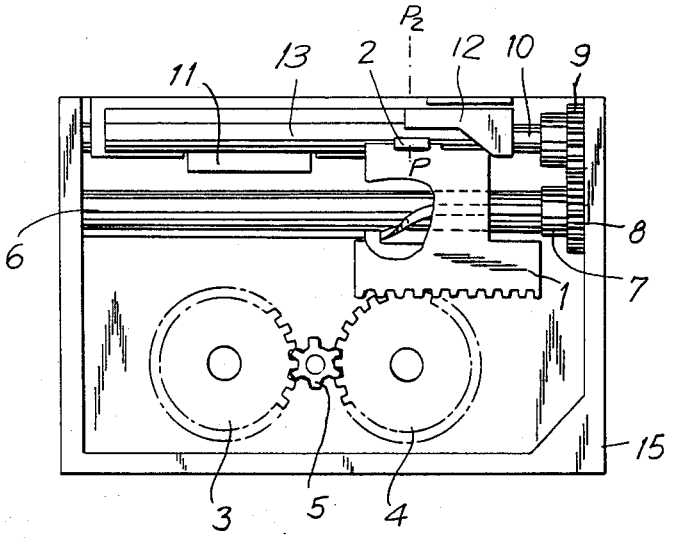
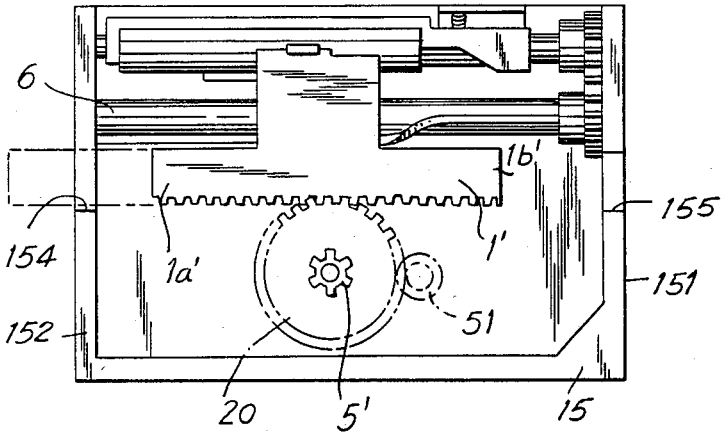
FIG. 7

SERIAL THERMAL PRINTER

BACKGROUND OF THE INVENTION

The present invention is directed to a serial thermal printer and, in particular, to a small-sized serial thermal printer having a thermal print head which is laterally movable and pressable against a platen having a sheet of thermal recording paper interposed therebetween for printing characters or smybols thereon.

Serial thermal printers print characters on a thermal recording paper or medium while pressing a thermal print head against the paper on a platen. When the sheet is to be advanced for printing on consecutive lines or otherwise, it is necessary to release the thermal head from pressing engagement with the sheet. One known construction for releasing the thermal head includes a feed screw or helical cam for driving the thermal head and a trigger electromagnet and clutch for releasing the platen and feeding the sheet of recording paper, such as is shown in Japanese Utility Model Laid-Open Publication No. 51-8139. According to another construction, the thermal print head is moved by a rope or string while the thermal head and platen are released by a plunger, such as is illustrated in Japanese Utility Model Laid-Open Publication No. 48-70525.

These conventional mechanisms are complex in structure and attempt to achieve a smaller size by arranging a drive motor horizontally inside or outside of the printer frame. A train of drive gears operatively coupled with the motor and an electromagnet and other parts are positioned outside of the frame in order to facilitate the attachment of the components in position. When the printer is to be installed in another device such as a desk top electronic calculator or the like, care must be exercised to place the printer with sufficient clearance provided therearound so that other parts will not contact the drive wheels and other members thereof. This constitutes an obstacle to efforts to make the overall device smaller in size. Accordingly, it is desired to provide an improved small-sized serial thermal printer which overcomes the problems associated with prior art constructions.

SUMMARY OF THE INVENTION

Generally speaking, in accordance with the present invention, a serial thermal printer for printing characters or symbols on a thermosensitive recording medium is provided. The printer includes a frame and a carriage supported on the frame for lateral movement across the recording medium. A thermal print head is supported on the carriage for lateral displacement therewith for printing on the recording medium. A platen is supported on the frame for supporting the recording medium so that the print head can be pressed against the recording medium to effect thermal printing thereon. A motor having a relatively flat configuration is supported on the frame and includes a rotatable shaft which is rotated by the motor. A drive gear system is operatively coupled to the rotatable shaft for selective rotation thereby in opposite directions in response to rotation by the motor. A conversion system converts the rotation of the drive gear system into movement of the carriage.

A paper feeding mechanism is operatively coupled to the carriage for feeding the recording medium past the print head. A platen release mechanism is selectively engageable with the carriage for releasing the print head from engagement with the platen.

In a preferred embodiment, the conversion system includes a rack on the carriage which is operatively coupled to a pair of drive gears which are enagaged with a motor gear on the motor.

Accordingly, it is an object of the present invention to provide an improved serial thermal printer.

Another object of the present invention is to provide a serial thermal printer which is small in size and has a reduced thickness.

A further object of the present invention is to provide a serial thermal printer which is capable of printing characters at a high speed while permitting of sheets of recording paper to be fed at high speed.

Still another object of the present invention is to provide a serial thermal printer requiring low electric power.

A still further object of the present invention is to provide a serial thermal printer which can be readily assembled and which is composed of a reduced number of parts which can be manufactured less costly.

Still other objects and advantages of the invention will in part be obvious and will in part be apparent from the specification.

The invention accordingly comprises the features of construction, combination of elements, and arrangement of parts which will be exemplified in the constructions hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which:

FIG. 2 is a cross-sectional view of the serial thermal printer depicted in FIG. 1A;

FIGS. 3 through 6 are plan views depicting successive steps of operation of the serial thermal printer depicted in FIG. 1A;

FIG. 7 is a plan view of a serial thermal printer constructed in accordance with a second embodiment of the present invention;

DESCRIPTION OF THE PREFERRED EMBODIMENTS

Figure 1A:
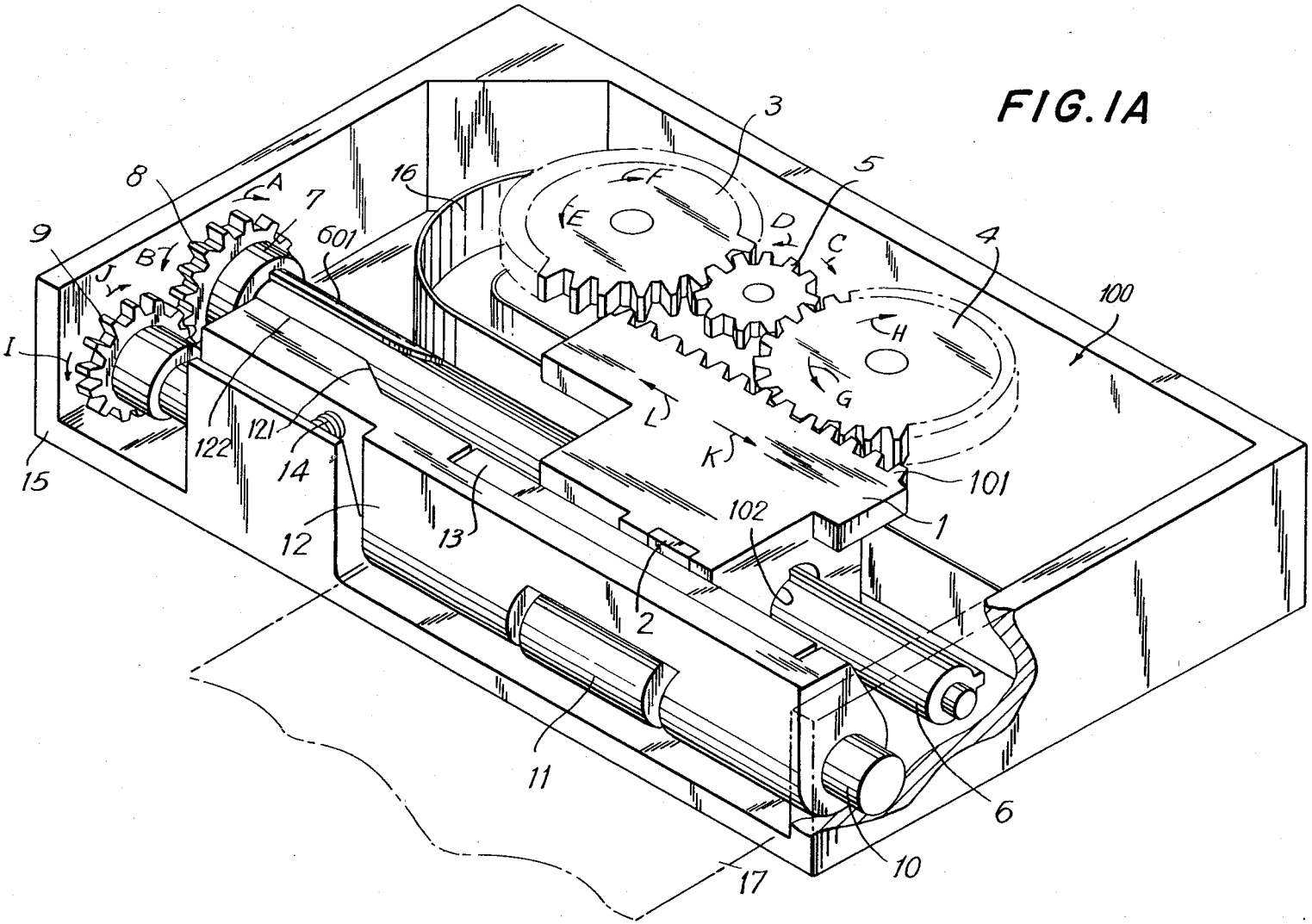
FIG. 1A is a perspective view of a serial thermal printer constructed in accordance with a preferred embodiment of the present invention.

Reference is first made to FIGS. 1A, 1B, 2 and 3 which depict a serial thermal printer, generally indicated at 100, constructed in accordance with a first embodiment of the present invention. Serial thermal printer 100 includes a carriage 1 which supports a thermal head 2 and a rack 101. Carriage 1 is carried on a cylindrical cam 6 which extends through a guide hole 102 defined in carriage 1. Cylindrical cam 6 is rotatably supported on a frame 15 of printer 100. Guide hole 102 has a recessed driver 103 held in fitting engagement with a ridge 601 on cylindrical cam 6.

A pair of drive gears 3 and 4 are rotatably positioned on opposite sides of a motor gear 5 for selective and simultaneous mesh with motor gear 5 which is coupled to a rotatable shaft 16*a* of a stepper motor 16. Rack 101 is also held in mesh with drive gears 3 and 4. Ridge 601 fitting in recessed driver 103 causes cylindrical cam 6 to angularly move about its own axis in the direction of arrows A or B as best seen in FIG. 2 while a center P of thermal head 2 moves from a position $P_1$ to a position $P_2$ or vice versa as depicted in FIG. 3 for an interval $S_3$ during movement of carriage 1 along cylindrical cam 6.

A one-way clutch 7 is axially interposed between cylindrical cam 6 and a clutch gear 8 angularly movably mounted coaxially on cylindrical cam 6 for transmitting rotation of cam 6 to clutch gear 8 in the direction of arrow A only. A paper feed gear 9 is fixed to a paper feed shaft 10 rotatably journalled on frame 15 and held in mesh with clutch gear 8. A paper feed roller 11 is secured to paper feed shaft 10. A platen holder 12 is rotatably fitted over paper feed shaft 10. Platen holder 12 supports a platen 13 and is normally urged by a spring 14 to turn in the direction of arrow J for pressing platen 13 closely against thermal head 2. Platen holder 12 also has a slant cam 121 projecting into the path of travel of carriage 1. Slant cam 121 is brought into engagement with carriage 1 only when the center P of head 2 moves from a position $P_4$ to a position $P_3$ for an interval $S_2$ when carriage 1 travels along cylindrical cam 6, thereby turning platen holder 12 in the direction of arrow I to release platen 13 from pressed engagement with thermal head 2.

As described hereinafter, the construction of the serial thermal printer of the present invention is highly advantageous in being assembled.

Figure 1B:
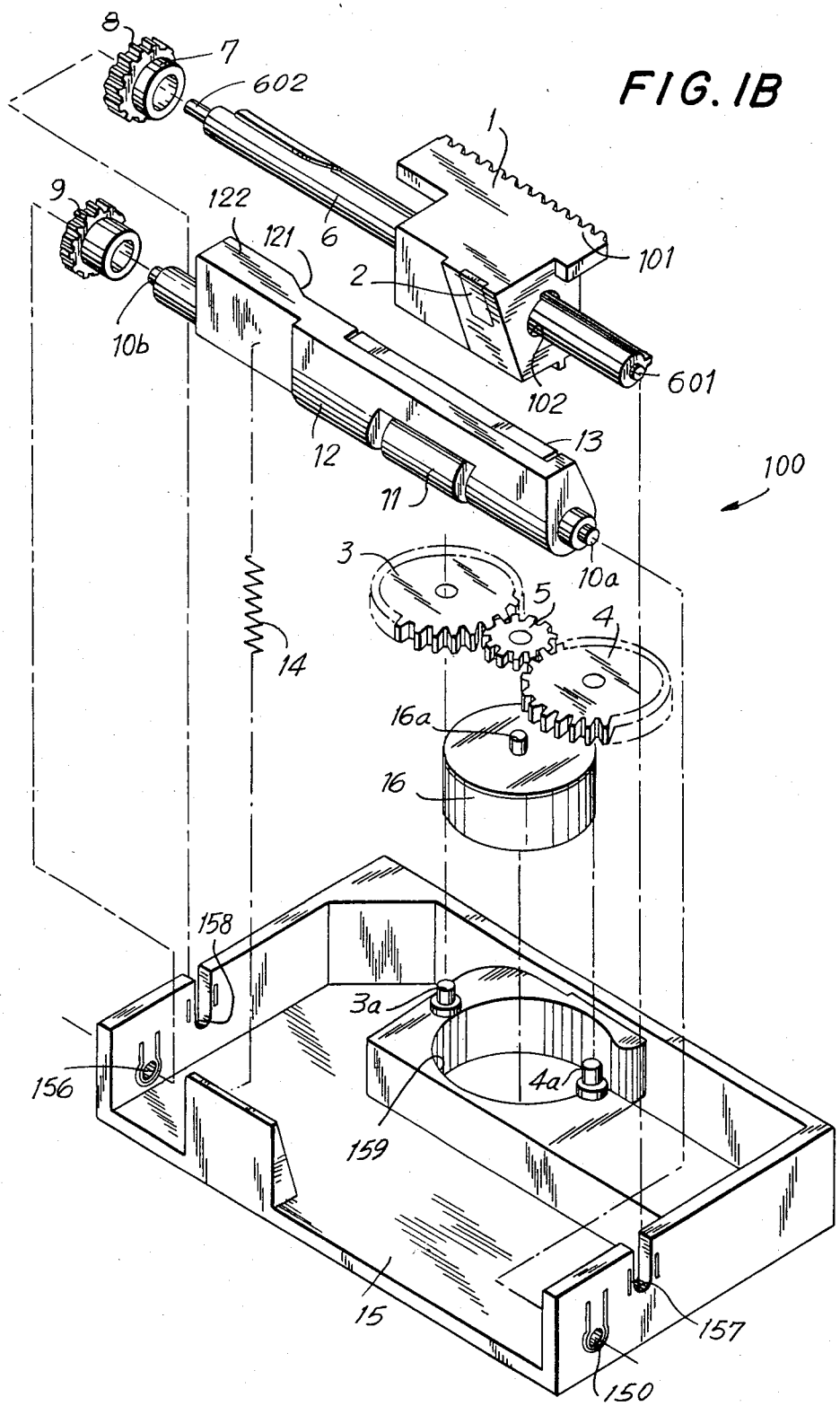
FIG. 1B is an exploded perspective view of the serial printer depicted in FIG. 1A.

As shown in the exploded view of FIG. 1B, all of the components of the printer can be assembled from above into frame 15. Frame 15 is preferably integrally molded from a plastic material. Motor 16 is inserted and located in a positioning cutout groove 159 defined in frame 15. Drive gears 3 and 4 are fitted over attachment pins 3*a* and 4*a*, respectively, projecting upwardly from frame 15. Then, cylindrical cam 6 is inserted into guide hole 102 in carriage 1, and clutch gear 8 and one-way clutch 7 are fitted over cylindrical cam 6.

Ends 601 and 602 of cylindrical cam 6 are fitted respectively into bearing recesses 157 and 158 defined in frame 15. Paper feed shaft 10 is likewise inserted into paper feed roller 11 and platen holder 12, and paper feed gear 9 is mounted on paper feed shaft 10. Then, ends 10*a* and 10*b* of paper feed shaft 10 are fitted respectively into bearing openings 150 and 156 defined in frame 15.

The serial thermal printer of the present invention is composed of a reduced number of parts. All components can be inserted from above into integrally molded frame 15. Accordingly, the serial thermal printer of the present invention can be assembled in a highly efficient manner. The shafts have ends which fit in the sidewalls of frame 15. There is no need to attach components to outer surfaces of the frame. This allows outside dimensions of the printer to be determined by the frame configuration. Therefore, it is easy to design a space in a desktop electronic calculator or the like for accommodating the printer of the present invention therein.

Operation of the serial thermal printer constructed as described above will now be described with reference to FIGS. 1A through 6. In the following description, the center P of thermal head 2 will be regarded as the position of carriage 1.

Figure 4:
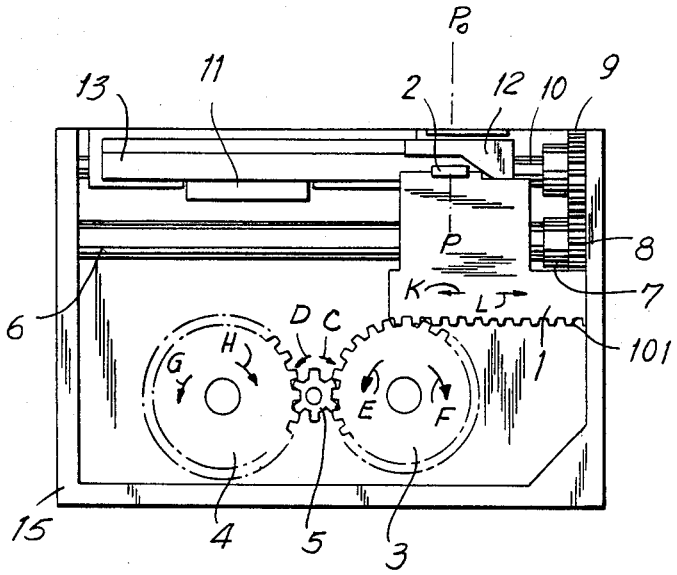

(1) Initialization and standby position ($P_0$):

In FIG. 3, carriage 1 is held against a righthand sidewall 151 of frame 15 when the center P of thermal head 2 is aligned with a standby position $P_0$, and against a lefthand sidewall 152 of frame 15 when the center P is aligned with a position $P_7$. Carriage 1 is movable only for an interval $S_0$ between the positions $P_0$ and $P_7$. When a drive signal is applied to motor 16 to rotate in the direction of arrow D, motor gear 5 is rotated in the direction of arrow D to rotate drive gears 3 and 4 in the directions of arrows F and H, respectively, whereupon carriage 1 starts moving from an unspecified rest position somewhere between positions $P_0$ and $P_7$ in the direction of arrow L. When carriage 1 reaches the standby position $P_0$, carriage 1 abuts against righthand sidewall 151 of frame 15 and is initialized in the standby position $P_0$ as illustrated in FIG. 4. Carriage 1 remains held in the standby position $P_0$ even when the drive signal is applied to motor 16 to rotate motor 16 in the direction of arrow D.

Figure 5:
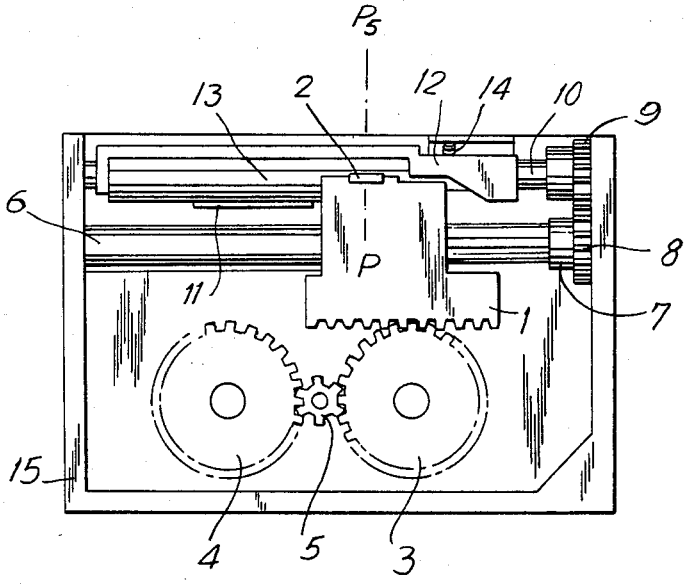

(2) Preparation for printing ($P_0$–$P_5$):

When a drive signal is applied to motor 16 to rotate in the direction of arrow C with carriage 1 in the standby position $P_0$ as shown in FIG. 4, motor gear 5 is rotated in the direction of arrow C to rotate gears 3 and 4 in the directions of arrows E and G, respectively. Carriage 1 with rack 101 meshing with drive gear 3 now begins moving in the direction of arrow K. When carriage 1 reaches the position $P_1$, cylindrical cam 6 starts being rotated in the direction of arrow B (FIGS. 1A and 2) by driver 103 in carriage 1, and continues to rotate until carriage 1 arrives at the position $P_2$ after traversing the interval $S_3$. Since one-way clutch 7 does not transmit rotation in the direction of arrow B, clutch gear 8, paper feed gear 9, and paper feed roller 11 remain at rest. As carriage 1 reaches the position $P_3$, carriage 1 disengages from a release surface 122 and engages slant cam 121. While carriage 1 moves for the interval $S_2$ to the position $P_4$, platen holder 12 is turned about paper feed shaft 10 in the direction of arrow J under the resilient force of spring 14. In the position $P_4$, thermal head 2 is pressed against platen 13 with a sheet 17 of recording paper interposed therebetween so that thermal head 2 will be held in intimate contact with sheet 17. Carriage 1 further moves to a printing start position $P_5$ in which it is readied for the printing operation as best illustrated in FIG. 5.

(3) Printing:

When the parts are ready for printing, a drive signal is applied to motor 16 to rotate in the direction of arrow C, and motor gear 5 rotates in the direction of arrow C to rotate drive gears 3 and 4 in the directions of arrows E and G, respectively. Carriage 1 moves in the direction of arrow K for an interval smaller than an interval $S_1$ up to a position $P_6$ in response to print data supplied from an external source. During such movement of carriage 1, thermal head 2 presses sheet 17 against platen 13 and effects predetermined printing thereon.

Where carriage 1 travels for a relatively small interval (fewer than the number of character positions) during the printing operation, rack 101 is kept in mesh with drive gear 3 only. As carriage 1 moves a longer interval, rack 101 is caused to mesh with both drive gears 3 and 4 simultaneously (FIG. 3) and then with drive gear 4 only. Carriage 1 thus moves in the direction of arrow K by being driven by motor 16.

(4) Return:

When carriage 1 moves to a prescribed position between the positions $P_5$ and $P_6$ dependent on print data supplied from the external source to thereby complete the printing operation, a drive signal is fed to motor 16 to rotate in the direction of arrow D. Motor gear 5 is rotated in the direction of arrow D, and drive gears 3 and 4 are rotated in the directions of arrows F and H, respectively. Rack 101 is brought into mesh with at least one of the drive gears 3 and 4, and carriage 1 returns in the direction of arrow L.

(5) Platen Release:

When carriage 1 moves past the position $P_5$ in the direction of arrow L and reaches the position $P_4$, carriage 1 engages slant cam 121 on platen holder 12, and further moves the interval $S_2$ in the direction of arrow L. Before reaching the position $P_3$, platen holder 12 is caused by slant cam 121 to turn about paper feed shaft 10 in the direction of arrow I against the resiliency of spring 14, whereupon thermal head 2 is released from pressed engagement with platen 13.

(6) Paper feed ($P_2$–$P_1$):

Carriage 1 further moves past the position $P_3$ in the direction of arrow L until carriage 1 arrives at the position $P_2$ as shown in FIG. 6. Cylindrical cam 6 starts to be turned in the direction of arrow A by driver 103 for a predetermined angular interval before carriage 1 further moves in the direction of arrow L and reaches the position $P_1$. Since the one-way clutch 7 can transmit rotation in the direction of arrow A only, clutch gear 8 rotates in the direction of arrow A to rotate paper feed roller 11 in the direction of arrow I through the intermediary of paper feed gear 9 and paper feed shaft 10, thereby feeding sheet 17 for a prescribed interval.

(7) Stop:

When carriage 1 further moves past the position $P_1$ in the direction of arrow L, carriage 1 is brought into abutting engagement with righthand sidewall 151 of frame 15 in the standby position $P_0$. Carriage 1 is thus stopped in the standby position $P_0$.

As described above, the initialization of carriage 1 is followed by a series of steps of the printing operation, that is (2) preparation for printing, (3) printing, (4) return, (5) platen release, (6) paper feeding, and (7) stop, for printing desired characters and symbols along a single line or successive lines.

Figure 8:
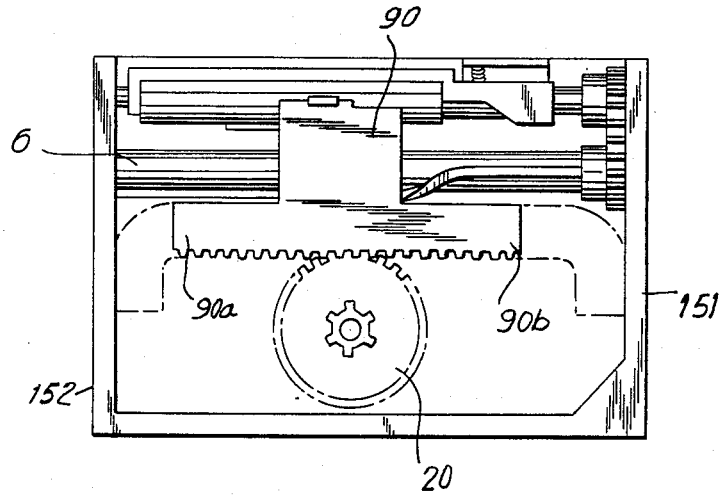
FIG. 8 is a plan view of a serial thermal printer constructed in accordance with a third embodiment of the present invention in which a carriage is formed from a pliable material.

The sheet can be fed at a fast rate as follows: After the initialization, carriage 1 is reciprocably moved first in the direction of arrow K from the standby position $P_0$ to the position $P_2$ and then in the direction of arrow L from the position $P_2$ to the standby position $P_0$. Cylindrical cam 6 is then caused by driver 103 to turn reciprocably for a prescribed angular interval. During this time, paper feed roller 11 is turned in the direction of arrow I through the intermediary of one-way clutch 7, clutch gear 8, paper feed gear 9 and paper feed shaft 10, thus feeding sheet 17 for a single print line. The above cycle of paper feeding operation is repeated to feed sheet 17 at a fast rate. To reduce the number of parts and simplify the overall construction, only one drive gear may be used to move the carriage. With this alternative embodiment, the interval in which the carriage can move may be increased. FIGS. 7 and 8 depict such a modified construction.

As shown in FIG. 7, a drive gear 20 is disposed coaxially with a motor gear 5'. Since the amount of movement of a carriage 1' is directly governed by the amount of rotation of the motor, however, it is difficult to effect fine control of the movement of carriage 1'. To avoid this difficulty, the motor may be displaced off center to a lateral position to place the motor gears in mesh with each other as shown in phantom at 51 with a gear ratio suitably selected. This permits desired fine control of the movement of carriage 1'. Lefthand sidewall 152 of frame 15 has an opening 154 through which an end **1*a'* of carriage 1' can project when carriage 1' moves to a position shown in phantom in FIG. 7. Likewise, righthand sidewall 151 of frame 15 has an opening 155 through which an opposite end 1*b'* of the carriage 1'** can project.

Carriage 1' is movable laterally on and along cylindrical cam 6 in response to rotation of the motor in the same manner as described above with reference to the arrangement shown in FIGS. 1A through 6.

FIG. 8 shows a carriage 90 having the same configuration as that of carriage 1' illustrated in FIG. 7, but made of a pliable material which can bend as depicted in phantom in FIG. 8. With this arrangement, the ends **90*a* and 90*b* of carriage 90 are flexibly confined within frame 15 without projecting outwardly of sidewalls 151 and 152**, and hence the printer as installed in another device does not take up a relatively large space.

Figure 9:
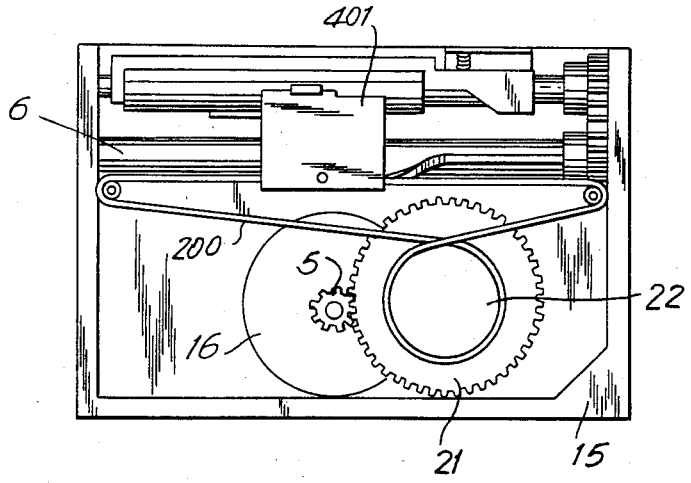
FIG. 9 is a plan view of a serial thermal printer constructed in accordance with a fourth embodiment of the present invention.

FIG. 9 illustates a serial thermal printer according to still another embodiment of the present invention. A motor 16 has a motor gear 5 held in driving mesh with a drive gear 21. A wire 200 is trained around a pulley 22 disposed coaxially with drive gear 21 and is connected to a carriage 401. Therefore, carriage 401 can be moved by wire 200 in response to rotation of pulley 22 driven by motor gear 5.

In the foregoing embodiments, motor 16 may be composed of a stepper motor with no position detector required. However, a DC motor may also be employed with a tachogenerator or a position detector associated therewith since other components are relatively few in number and, hence, such a motor arrangement does not adversely affect any attempt to reduce the size and thickness of the printer. Therefore, either type of motor is available for use in the printer.

With the arrangement of the present invention, the motor disposed flatwise is interposed between the sidewalls of the frame, and substantially no parts are placed outwardly of the frame. A device, such as for example as desktop electronic calculator in which the printer of the invention is to be incorporated, can be rendered compact while avoiding problems which would otherwise be caused from contact between the components of the printer and surrounding parts of the device.

The cylindrical cam doubles as a guide shaft for the carriage and an actuator for feeding a sheet of recording paper. The sheet can be fed along in response to movement of the carriage for a predetermined interval. The platen can be released from engagement with the thermal head when the carriage traverses a prescribed distance to engage the slant cam on the platen holder. The sheet can be fed for one line without the carriage traversing the full width along the print line. The sheet also can be fed at a rapid rate by repeating a cycle of sheet feeding movement of the carriage.

The printer of the above construction has no parts attached to outer and lower sides of the frame, and can be assembled by placing the components from above into the frame. Therefore, the printer of the invention lends itself to a mechanized assembly.

The arrangement of the invention makes it possible to fabricate a serial thermal printer having dimensions equal to or smaller than a width of 60 mm, a depth of 40 mm, and a height of 10 mm. Accordingly, a desktop electronic calculator in which such a printer is incorporated can be made small in size and thickness.

It will thus be seen that the objets set forth above, among those made apparent from the preceding description, are efficiently attained and, since certain changes may be made in the above constructions without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. A serial thermal printer for printing on a thermosensitive recording medium comprising a frame, a carriage supported on said frame for lateral movement across said recording medium, a thermal print head supported on said carriage for lateral displacement therewith for printing on said recording medium, platen means supported on said frame for supporting said recording medium so that said print head can be pressed against said recording medium to effect thermal printing thereon, motor means having a relatively flat configuration supported on said frame and having a vertical rotatable shaft which is rotated by said motor means, drive gear means operatively coupled to said rotatable shaft for selective rotation thereby in opposite directions in response to rotation by said motor means, converting means for converting rotation of said drive means into lateral movement of said carriage, paper feed means operatively coupled to said carriage for feeding said recording medium past said print head, and platen release means selectively engageable with said carriage for releasing said print head from engagement with said platen means.

2. The serial thermal printer as claimed in claim 1, wherein said converting means includes a rack on said carriage operatively coupled to said drive gear means.

3. The serial thermal printer as claimed in claim 2, wherein said drive gear means includes a motor gear mounted on said rotatable shaft and a pair of drive gears operatively coupled to said motor gear for rotation thereby, said rack being selectively engageable by said pair of drive gears.

4. The serial thermal printer as claimed in claim 3, wherein said paper feed means includes a cylindrical cam having an inverse cam carrying said carriage thereon, said inverse cam being angularly movable in response to movement of said carriage therealong, and a paper feed roller operatively coupled to said cylindrical cam for rotation in response to angular movement of said cylindrical cam.

5. The serial thermal printer as claimed in claim 4, wherein said paper feed means further includes a one-way clutch coupling said cylindrical cam to said paper feed roller.

6. The serial thermal printer as claimed in claim 5, wherein said platen release means includes a slant cam projecting from said platen means into the path of movement of said carriage.

7. The serial thermal printer as claimed in claim 6, wherein said cylindrical cam operates after said slant cam effects release of said platen from said head.

8. The serial thermal printer as claimed in claim 7, wherein said rotor means is a stepper motor.

9. The serial thermal printer as claimed in claim 1, wherein said paper feed means includes a cylindrical cam having an inverse cam carrying said carriage thereon, said inverse cam being angularly movable in response to movement of said carriage therealong, and a paper feed roller operatively coupled to said cylindrical cam for rotation in response to angular movement of said cylindrical cam.

10. The serial thermal printer as claimed in claim 9, wherein said paper feed means further includes a one-way clutch coupling said cylindrical cam to said paper feed roller.

11. The serial thermal printer as claimed in claim 10, wherein said platen release means includes a slant cam projecting from said platen means into the path of movement of said carriage.

12. The serial thermal printer as claimed in claim 11, wherein said cylindrical cam operates after said slant cam effects release of said platen from said head.

13. The serial thermal printer as claimed in claim 12, wherein said motor means is a stepper motor.

14. The serial thermal printer as claimed in claim 1, wherein said motor means is a stepper motor.

15. The serial thermal printer as claimed in claim 1, wherein said carriage includes two deformable ends, said two ends being deformed when pressed against said frame.

16. The serial thermal printer as claimed in claim 2, wherein said drive gear means includes a drive gear rotatable by said motor means and in meshing engagement with said rack.

17. The serial thermal printer as claimed in claim 16, wherein said drive gear is mounted on said rotatable shaft.

18. The serial thermal printer as claimed in claim 12, wherein said drive gear means includes a drive gear rotatable by said motor means and in meshing engagement with said rack.

19. The serial thermal printer as claimed in claim 18, wherein said drive gear is mounted on said rotatable shaft.

20. The serial thermal printer as claimed in claim 12, wherein said drive gear means includes a drive gear rotatable by said motor means, said drive gear having a pulley disposed thereon, said converting means including a wire trained around said pulley and coupled to said carriage.

* * * * *